US010266365B2

(12) United States Patent
De Danschutter et al.

(10) Patent No.: US 10,266,365 B2
(45) Date of Patent: Apr. 23, 2019

(54) PACKAGE WITH HIGH YOUNG'S MODULUS YARN AND METHOD FOR WINDING THE YARN PACKAGE

(71) Applicant: DSM IP ASSETS B.V., Heerlen (NL)

(72) Inventors: Evert Florentinus Florimondus De Danschutter, Echt (NL); Herbert Rabe, Echt (NL); Carsten Goerke, Echt (NL)

(73) Assignee: DSM IP ASSETS B.V., Heerlen (NL)

( * ) Notice: Subject to any disclaimer, the term of this patent is extended or adjusted under 35 U.S.C. 154(b) by 76 days.

(21) Appl. No.: 15/662,019

(22) Filed: Jul. 27, 2017

(65) Prior Publication Data

US 2017/0369270 A1 Dec. 28, 2017

Related U.S. Application Data

(62) Division of application No. 13/640,134, filed as application No. PCT/EP2011/055462 on Apr. 7, 2011, now Pat. No. 9,751,717.

(30) Foreign Application Priority Data

Apr. 7, 2010 (EP) ..... 10159265

(51) Int. Cl.
*B65H 54/08* (2006.01)
*B65H 54/38* (2006.01)
*B65H 55/04* (2006.01)

(52) U.S. Cl.
CPC ..... *B65H 55/04* (2013.01); *B65H 54/08* (2013.01); *B65H 54/383* (2013.01); *B65H 54/388* (2013.01); *B65H 2701/31* (2013.01)

(58) Field of Classification Search
CPC ..... B65H 55/04; B65H 54/04; B65H 54/388; B65H 54/383; B65H 54/08; B65H 2701/31
See application file for complete search history.

(56) References Cited

U.S. PATENT DOCUMENTS

| | | | |
|---|---|---|---|
| 2,652,987 | A | 9/1953 | Osborne |
| 3,402,898 | A | 9/1968 | Mattingly |
| 3,718,288 | A | 2/1973 | Jennings |
| 4,544,113 | A | 10/1985 | Yoshinaga et al. |
| 4,586,679 | A | 5/1986 | Yamamoto et al. |
| 4,983,457 | A | 1/1991 | Hino et al. |
| 4,986,483 | A | 1/1991 | Ryu |

(Continued)

FOREIGN PATENT DOCUMENTS

| | | |
|---|---|---|
| CN | 1358242 | 7/2002 |
| CN | 1555433 | 12/2004 |

(Continued)

OTHER PUBLICATIONS

International Search Report for PCT/EP2011/055462 dated Jul. 18, 2011.
Written Opinion of the International Searching Authority dated Jul. 18, 2011.
JP Office Action dated Mar. 10, 2015.
"Manual of Winding Technology", Georg Sahm GmbH & Co., 1st Ed. 1995, pp. 1-16.
"Yarn Package Hardness Tester HP-2.5", http://www.hans-schmidt.com/EN/products/yarn_package_hardness_tester/hardness_tester/hp_series/model_hp-25 (2015).

(Continued)

*Primary Examiner* — William E Dondero
(74) *Attorney, Agent, or Firm* — Nixon & Vanderhye P.C.

(57) ABSTRACT

The invention concerns an improved yarn package and a method winding a package of high Young's modulus yarn. The package has a low normalized standard deviation in unwinding tension and hence is very suitable for converting into a range of yarn constructions and particularly medical products.

26 Claims, 3 Drawing Sheets

(56) References Cited

U.S. PATENT DOCUMENTS

| | | | |
|---|---|---|---|
| 5,533,686 | A | 7/1996 | Wirz |
| 6,027,060 | A | 2/2000 | Siepmann |
| 6,276,624 | B1 | 8/2001 | Endo et al. |
| 6,620,502 | B1 | 9/2003 | Fujimoto et al. |
| 7,246,764 | B2 | 7/2007 | Planck et al. |
| 7,665,682 | B2 | 2/2010 | Stahlecker et al. |
| 7,942,359 | B2 | 5/2011 | Kiriyama et al. |
| 2003/0108740 | A1 | 6/2003 | Koyanagi et al. |
| 2007/0222104 | A1 | 9/2007 | Sukuzi |
| 2008/0044654 | A1 | 2/2008 | Cadoret et al. |
| 2008/0156917 | A1 | 7/2008 | Stahlecker et al. |
| 2009/0121380 | A1 | 5/2009 | Olry et al. |
| 2011/0282451 | A1 | 11/2011 | Sporring et al. |

FOREIGN PATENT DOCUMENTS

| | | |
|---|---|---|
| EP | 0 117 049 | 8/1984 |
| EP | 1 125 880 | 8/2001 |
| JP | 59-108656 | 6/1984 |
| JP | 59-133173 | 6/1984 |
| JP | 06-127820 | 5/1994 |
| JP | 2002-3081 | 1/2002 |
| JP | 2008/037650 | 2/2008 |

OTHER PUBLICATIONS

"Manual of Winding Technology", Georg Sahm GmbH & Co., 1st Ed. 1995, pp. 1-182.

Office Action, CN Appln. No. 201510239465.7, dated May 4, 2017.

PACKAGE WITH HIGH YOUNG'S MODULUS YARN AND METHOD FOR WINDING THE YARN PACKAGE

CROSS-REFERENCE

This application is a divisional of commonly owned copending U.S. Ser. No. 13/640,134, filed Dec. 22, 2012 (now U.S. Pat. No. 9,751,717), which is the U.S. national phase application of International Application No. PCT/EP2011/055462 filed Apr. 7, 2011 which designated the U.S. and claims priority to EP 10159265.7 filed Apr. 7, 2010, the entire contents of each of which are hereby incorporated by reference.

TECHNICAL FIELD OF THE INVENTION

The invention relates to a package with high Young's modulus yarn, such as High Performance Polyethylene (HPPE). More particularly, the invention relates to a package where the yarn is arranged on the bobbin according to a dedicated winding pattern. Furthermore, the invention relates to the winding pattern.

BACKGROUND OF THE INVENTION

Synthetic as well as natural yarns are typically supplied as continuous yarn on bobbins. The yarn is distributed onto the bobbin by winding devices, such as for example disclosed in 'Manual of Winding Technology', Georg SAHM GmbH & Co., 1st ed. 1995. Winding is traditionally conducted by constant-angle cross winding (where the helix angle is kept constant) or precision cross winding (where the number of rotations of the bobbin per double stroke of the yarn guide is constant).

Also high Young's modulus yarns are typically supplied on a bobbin. Traditionally, the aim of the winding has been to provide a package with high packing density and high mechanical stability in the sense of high hardness and low tendency of the yarn to slide from the bobbin when the bobbin is arranged vertically without tension on the yarn. This is realized by winding based on closed precision cross winding the high Young's modulus yarn with a high bail pressure.

OBJECTS OF THE INVENTION

It is an object of the invention to provide an improved package of high Young's modulus yarn.

In another aspect of the invention, it is an object of the invention to provide a method of preparing an improved high Young's modulus yarn package on a bobbin.

In a further aspect of the invention, it is an object of the invention to provide uses of the package of high Young's modulus yarn.

The improvement may for example be one or more of a reduction in variation of unwinding stress, a reduction in yarn damage during winding and/or unwinding, an improvement in yarn holding on the bobbin, or another features of the invention.

SUMMARY OF THE INVENTION

A bobbin is the core whereon the yarn is wound. The bobbin of the package is preferably a cylindrical bobbin which bobbin is perforated or non-perforated. The package is an open precision cross winding package wound on the bobbin. In FIG. 1, a schematic representation of a precision cross winding package is shown. The package according to the invention has two ends and the number of ligatures 10 at each of the ends is 8 to 25. Herein, a ligature is the turning point at the end of the package, where the yarn changes from running towards one end of the package to running towards the other end of the package. The number of ligatures at each of the ends of the package is the number of turning points at the end of the package before the yarn is positioned adjacent to the same yarn turning point again. In other words, the number of ligatures is the number of double strokes by the yarn guide from starting in an initial position at the end till laying the yarn adjacent to the initial position (separated by δ). Typically, the number of ligatures at each of the ends is low such as 4 or 5. An example is Penta Wind, p. 37 in 'Manual of Winding Technology', Georg SAHM GmbH & Co., 1$^{st}$ ed. 1995. The number of ligatures at each end is traditionally kept constant throughout the whole package, as this is mechanically the simplest solution and would otherwise lead to non-symmetric packages when changing the number of ligatures.

The package 6 in FIG. 1 is formed by the yarns 2*a*, 2*b* positioned on the bobbin 8. The yarns 2*a*, 2*b* are positioned at an orthogonal distance δ between the centres of the yarns 2*a*, 2*b* (also referred to as the δ-value). By 'open' is here meant that adjacent yarns 2*a*, 2*b* are separated by a distance 4 and hence adjacent positioned yarns 2*a* and 2*b* do not touch each other over most of the distance between the ends of the package. In other words, the δ-value is larger than the width, $W_{yarn}$, of the yarn 2*a*, 2*b*. Surprisingly it was found that the combination of high number of ligatures at each end combined with open precision cross winding package greatly reduced the likelihood of yarns being hooked between adjacent yarns and hence reduced the variation in unwinding tension of the package. Even more surprisingly, it was found that this winding package was particularly advantageous when the package is relatively small, such as less than 500 g and particularly when the package is less than 250 g. For larger packages, such as packages of more than 2 kg, 4 kg, 6 kg or even 10 kg or more, it was found to be advantageous to use a step open precision cross winding package. Here 'step' refers to a reduction in helix angle during the winding so that an outer layer has a lower helix angle that an inner layer. This is realized by an abrupt increase in helix angle of outer parts of the package as compared to inner parts of the package. Use of steps have for example been describe in EP 0055849A2.

In another aspect of the invention (which aspect is combinable with the first aspect of the invention), the object of the invention is realized by a package of yarn wherein the variation in unwinding tension is less than 1.5 normalized standard deviations of the mean unwinding tension measured for 1000 m as Over End Take Off (OETO) with a unwinding speed of 150 m/min. The normalized standard deviation is the ratio of the standard deviation of the unwinding tension and the mean unwinding tension. It was found that this level of variation in the unwinding tension was advantageous for most yarns as more even yarn take off leads to more homogeneous yarn construction. In a preferred embodiment, the normalized standard deviation of the unwinding tension is less than 1.25, and more preferably the variation in unwinding tension is less than 1.1. These preferred embodiments are particularly advantageous for thin high Young's modulus yarns, such as HPPE, as the very low elasticity of high Young's modulus yarn increases the sensitivity of the yarn towards abrupt changes in unwinding tension. The low variation in unwinding tension may also be described by the Package Performance Factor (PPF). In this aspect of the invention, the PPF is less than 150 and preferably less than 100. It was found that the preferred embodiment is particularly advantageous for thin, high Young's modulus yarns, such as HPPE with a yarn diameter of less than 150 μm.

BRIEF DESCRIPTION OF THE DRAWINGS

The invention will be explained more fully below with reference to exemplary embodiments as well as the drawings, in which.

All figures are highly schematic and not necessarily to scale, and they show only parts which are necessary in order to elucidate the invention, other parts being omitted or merely suggested.

DETAILED DESCRIPTION

Experimental work showed that the package preferably should have a positive wind (positive δ-value). Positive wind does not influence the unwinding by Over End Take Off, but is an advantage during winding of the package as newly placed yarns would be prevented from being dragged off by previously placed yarns. This was particularly the case for high Young's modulus yarn having a low coefficient of friction, such as e-PTFE and High Performance Polyethylene (HPPE) fibers.

In a highly preferred embodiment, the number of ligatures at each of the ends is 11 to 19. It was surprisingly found that this embodiment provided a mechanically very stable package without hooking of yarns between lower layers of yarn and hence allowed for a very stable unwinding. Furthermore the package was very stable in that even if a yarn got loose so that a number of windings shifted, then the shifting would be stopped by the high number of ligatures, which prevented neighbouring yarns from slipping and creating a cascade effect. This effect is caused by the high number of yarn layers (corresponding to the number of ligatures) which had slipped before neighbouring yarns were shifted. This stabilizing effect of the package according to the invention is particularly advantageous for high Young's modulus yarn, where stretching of the yarn due to winding tension cannot absorb the extra length of yarn due to the shifting as a more elastic yarn may.

Figure 1:
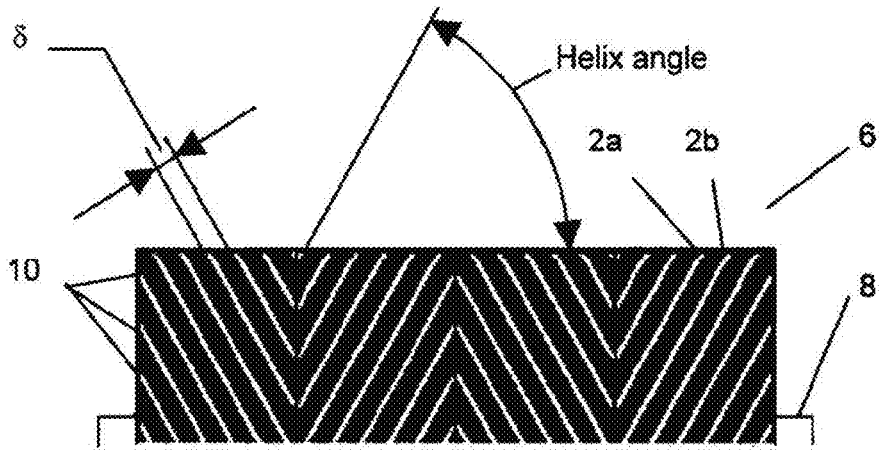
FIG. 1 shows a schematic representation of a precision cross winding package, FIGS. 2A-2E respectively show schematic representations of packages with undisturbed ends (FIG. 2A) and disturbed ends (FIGS. 2B-2E)

By open precision cross winding package the helix angle will increase with increasing package diameter. In FIG. 1, the definition of the helix angle is indicated. In one embodiment of the package according to the invention it was found that the helix angle advantageously should be 75° to 86° and for HPPE a helix angle of 78° to 85° was found to be particularly advantageous. Furthermore, it was found that these helix angle ranges could be realised even for large packages when utilizing step open precision cross winding. By the helix angle being in the specified ranges is herein meant that at least 80 weight-% of the yarn of the package has a helix angle in the range. Hence the innermost or outermost part of the package and/or the part close to the ends of the package may have a helix angle outside the specified range for example to increase coherence of the completed package or improve fixation of the yarn on the bobbin without deviating from the spirit of the invention. However, it is highly preferred that substantially all the yarn of the package has a helix angle in the range, such as at least 90 weight-% of the yarn and most preferably at least 95 weight-% of the yarn of the package has a helix angle in the range. For large packages this may require that the helix angle needs to be adjusted during the winding. This is referred to as step open precision cross winding package. By introducing a series of steps, such as about 5 to 25 helix angle steps, it was found that even the narrow interval of the preferred range could be realized for packages of 4 to 10 kg of HPPE.

By modulus is herein meant Young's modulus, and the terms modulus and Young's modulus will be used interchangeably. A high Young's modulus yarn is herein a yarn with a Young's modulus of more than 30 GPa. However, the advantage of the package and the method of winding the yarn are particularly pronounced for yarn with very high Young's modulus of for example a 50 GPa, 75 GPa, 100 GPa or even higher, such as HPPE. It was found that the package was particularly advantageous for yarns that combined very high Young's modulus and low friction coefficient, such as UHMWPE based gelspun HPPE yarn. The yarn may be a monofilament or a multifilament yarn. Multifilament yarns comprise at least two filaments, which filaments may be twisted, untwisted, braided (from monofilaments or collections of monofilaments), entangled or any combination of these into the yarn. The invention hence also encompasses winding of yarn constructions and winding packages of yarn constructions such as braidings with a substantially round cross section and braidings with an elongated cross section, such as a (narrow) braided band or a braid that collapses to form an elongated structure during winding, such as a hollow braid. Examples of high Young's modulus yarns are High Modulus Aramid fibers (HMA), Carbon fibers, e-PTFE and HPPE. Monofilaments encompass monofilaments with a substantially round cross sections and monofilaments with an elongated cross section, such as (narrow) band, a ribbon, a tape, a (twisted) slit tape, or monofilament-like structure like a collection of (partially) fused monofilaments or multifilament yarns.

A major difficulty of winding high Young's modulus yarns is the lack of grapping of the yarn to the bobbin as may be observed for more elastic fibers. This means that the yarn is likely to fall off the package or at least displace the outer layers of the package if placed vertically without tension in the yarn. Traditionally this issue has been solved by using close packing and relatively low helix angles as this improves the coherence of the package. For relatively thick high Young's modulus yarns, this is an acceptable solution; however it was surprisingly observed that for thinner yarns this did not always lead to suitable unwinding properties and could even damage the yarn during winding or unwinding.

It was found that the package according to the invention was particularly advantageous when the yarn had a combination of high Young's modulus and high tenacity. In one embodiment it was found to be advantageous that the yarn of the package according to the invention has a tenacity of at least 13 cN/dtex, preferably the yarn has a tenacity of at least 17 cN/dtex. The highest advantage was observed for high performance yarns with a tenacity of at least 30 cN/dtex, such as at least 35 cN/dtex. The advantage for high tenacity yarns did not seem to diminish for yarns of higher tenacities; however, in one embodiment the yarn has a tenacity of less than 75 cN/dtex.

By HPPE is herein understood High Performance Polyethylene, which is yarn based on stretched polyethylene with a Young's modulus of at least 30 GPa. HPPE may for example be prepared by a meltspinning process (as for example disclosed in EP1445356), by solid state process (as for example disclosed in EP1627719) or by gelspinning (as for example disclosed in WO 2005/066401). A particularly preferred type of HPPE is gelspun ultra high molecular weight polyethylene (UHMWPE), where the UHMWPE has an intrinsic viscosity (IV) as measured on solution in decalin at 135° C., of at least 5 dl/g, preferably at least 10 dl/g, more preferably at least 15 dl/g, most preferably at least 21 dl/g. Preferably, the IV is at most 40 dl/g, more preferably at most 30 dl/g, even more preferably at most 25 dl/g. Gelspun UHMWPE typically has a Young's modulus of at least 50 GPa.

The yarn has a width, $W_{yarn}$. Herein, $W_{yarn}$ is the largest dimension of a cross section of the yarn transverse to the length direction of the yarn.

The higher the δ-value, the more open the winding package. For a preferred embodiment it was found that when the package according to the invention has a δ-value of at least 2 $W_{yarn}$, and preferably at least 4 $W_{yarn}$, then the hooking of yarns are reduced considerably. However, if the δ-value became too large, then the mechanical coherence of the package was reduced. Therefore it is preferred that the δ-value is at most 100 $W_{yarn}$. Most preferred was a δ-value of between 2 $W_{yarn}$ and 20 $W_{yarn}$.

Particularly for yarns with a very small $W_{yarn}$, such as $W_{yarn}$<100 μm, it was found to be advantageous to have a δ-value of between ($W_{yarn}$+0.5 mm) and ($W_{yarn}$+3 mm). In other words, in this embodiment, the distance between the yarn centres of adjacent yarns is between about 0.5 mm and 3 mm. It was found that this allowed for a suitably open distribution with low risk of hooking of the yarn when combined with a high number of ligatures at the end as discussed elsewhere. Yet these δ-values allows for adjacent yarns to support each other, if slippage of the yarn is initiated. Particularly for yarns with low linear density it was found to be particularly advantageous to utilize a δ-value of between ($W_{yarn}$+0.8 mm) and ($W_{yarn}$+2 mm). For HPPE, this was found to be particularly advantageous for yarns with a linear density of less than 120 dtex, and more particularly for yarns with a linear density of less than 45 dtex.

In a preferred embodiment, the hardness of the package is 50° Sh to 80° Sh. Softer packages tended to become unstable and harder packages tended to have increased variation of unwinding tension. More preferably, the hardness of the package is 60° Sh to 75° Sh, which was found to yield good performance in respect of variation in unwinding tension and stability of the package for high Young's modulus yarns and particularly for HPPE yarns. The hardness of the package is measured as the average value of the hardness along the length of the package. The hardness of the package is affected by a combination of the bail pressure and the yarn tension during winding in combination with the winding pattern. It was found that bail pressure and yarn tension could be varied considerably during the winding as long as the hardness of the package was kept within the specified range. In general, it was found to be advantageous to utilise a combination of low bail pressure and low yarn tension as this reduces the hooking of yarns. On the other hand, very low bail pressure and yarn tension (particularly in combination with a large δ-value) tended to result in an unstable package.

The hardness typically varies between the end region of the package and the centre region of the package due to excess material being provided near the ends when the traveller changes direction due to stopping and acceleration of the traveller. In a preferred embodiment, the variation of hardness is kept very low. It was found to be highly advantageous to keep the difference in hardness of the package 1 cm from the end and the hardness of the package on the middle of the package at less than 10° Sh. Particularly advantageous were packages with a difference in hardness of the package 1 cm from the end and the hardness of the package on the middle of the package of less than 5° Sh. This allowed for very high quality of packages.

Figure 2A:
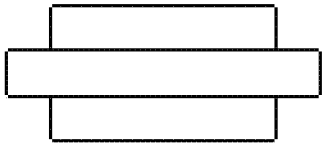
Figure 2B:
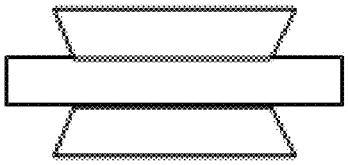
Figure 2C:
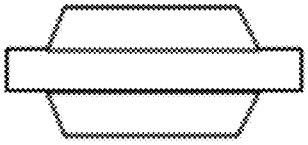
Figure 2D:
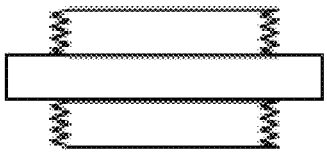
Figure 2E:
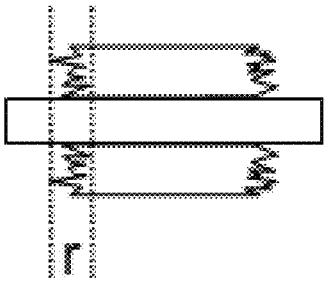

The ends of the package may be (substantially) orthogonal to the bobbin (see FIG. 2A—also referred to as a cheese), which represents a preferred embodiment of the invention. However, in another preferred embodiment, at least one of the ends of the package is disturbed. It was found that a disturbed end tended to reduce the effect of increased material being provided near the ends of the package due to slowing down and acceleration of the traveller near the end during winding. Disturbed ends were found to provide a preferred means to reduce the difference in hardness of the package 1 cm from the end and the hardness of the package on the middle of the package. By an end being disturbed is here meant that the end is not (substantially) orthogonal to the bobbin. The disturbance may cover the whole of the end of the package or only a limited part of the end of the package, such as the end for higher or lower diameters of the package. For clarity partially disturbed ends are not shown in FIG. 2. Examples of disturbed ends are when the end is tapered inwards (towards the other end of the package—see FIG. 2C) or tapered outwards (away from the other end of the package—see FIG. 2B), zigzagged (see FIG. 2D) or randomly distributed length (see FIG. 2E) in a range, r, near the end of the package. Most preferred was when at least one of the ends is tapered outwards.

In principle, the package according to the invention may be utilized for any width yarn, however, the advantage of the low unwinding resistance or low variation in unwinding resistance is particularly developed for yarns with low width, as yarns with low widths are more sensitive to peaks in unwinding resistance as such peaks may be larger than the tensile strength of the yarn leading to filament breakage or even yarn breakage. Hence, in an advantageous embodiment the yarn has a width of less than about 0.5 mm. Preferably, the yarn has a width of less than about 0.1 mm, and more preferably the yarn has a width of less than about 50 μm, such as a yarn width of less than about 25 μm.

In general, the package according to the invention may comprise yarns of any linear density, however the package is particularly advantageous for yarns of relatively low widths as such yarns are particularly prone to filament breakage or even yarn breakage in conventional packages. In a preferred embodiment, the linear density of the yarn is at most 500 dtex, preferably at most 120 dtex, more preferably at most 45 dtex, and most preferably at most 20 dtex.

In principle, the package according to the invention may be utilized for a yarn having any filament width. Herein, filament width is the largest dimension of a cross section of the filament transverse to the length direction of the filament. However, the advantage of the low unwinding resistance or low variation in unwinding resistance is particularly developed for yarns having filaments of with low width, as filaments with a low width are more sensitive to peaks in unwinding resistance as such peaks may be larger than the tensile strength of the filament leading to filament breakage and hence fluff formation, quality reduction or eventually even yarn breakage. Hence, in an advantageous embodiment the yarn comprises at least one filament having a width of less than about 17 μm. Preferably, the yarn comprises at least one filament having a width of less than about 12 μm, and more preferably the yarn comprises at least one filament having a width of less than about 8 μm.

Another aspect of the invention concerns a method of winding a package of high Young's modulus yarn. The method comprises the steps of providing a cylindrical bobbin, winding a high Young's modulus yarn onto the bobbin to form a package having two ends, wherein the winding pattern is an open precision cross winding and the number of ligatures at each of the ends is 8 to 25, preferably the number of ligatures at each of the ends is 11 to 19.

In a preferred embodiment, the yarn has a width, $W_{yarn}$, and the winding pattern has a δ-value of between 2 $W_{yarn}$ and 100 $W_{yarn}$, which was found to yield a package with reduced risk of hooking of the yarn. In a preferred embodiment of the invention, the δ-value of between 2 $W_{yarn}$ and 20 $W_{yarn}$, which allowed for a closer packing and a better support of neighbouring yarns (such as for example yarns 2*a* and 2*b* on FIG. 1).

In yet another embodiment of the invention, the winding pattern has a helix angle of about 75° to 86°. It was found that this method provides a yarn package having a low unwinding tension, with a systematic pattern, and/or without large fluctuations and no high peaks. The helix angle is more preferably 78° to 85°, which was found to provide the best compromise for HPPE between coherence of the resulting yarn package and the variation in unwinding tension.

In yet another preferred embodiment, it was found that for large yarn packages, corresponding to for example more than about 4 kg of HPPE, it was advantageous to include at least one step in the helix angle of the winding pattern and more preferably the winding pattern includes more steps in helix angle, such as for example at least two, three, four, five, ten, 20, 25 or even more steps in the helix angle. The number of steps should be sufficiently low that the helix angle is not kept substantially constant, as this would lead to a random winding package, which is undesired as it leads to too high unwinding tension. The method according to the invention is preferably conducted on a winder where the motor controlling the rotation of the bobbin is driven independently of the motor controlling the yarn guide so that the winding speed and the helix angle may be adjusted during the winding.

The package and the winding method according to the invention are particularly advantageous for use in braiding, knitting, weaving, twisting and/or other yarn conversions of thin yarns of high Young's modulus as it allows for a more even delivery of the yarn and hence a more even tension during yarn conversion. Particularly for medical applications where minimum invasive techniques requires the use of still thinner yarns, the package and winding method is a major advantage. Hence in a preferred embodiment of the invention, the package according to the invention is used in a yarn construction that is a medical device or the yarn construction forms part of a medical device.

EXAMPLES

Unwinding tension was measured by a Honigmann unwinding performance tester UPT-100 and analysed using Honigmann HCC-PPT software package.

The unwinding tension was measured as Over End Take Off (OETO) with a unwinding speed of 150 m/min, and a distance between bobbin and guide eye of 50 cm. The guide eye was a ceramic $Al_2O_3$ guide eye. The bobbin was arranged horizontally and the centre of the bobbin and the guide eye were arranged at the same height. Test length was 1000 m where after the results were analysed using Honigmann HCC-PPT software package.

Comparative Example 1

Figure 3:
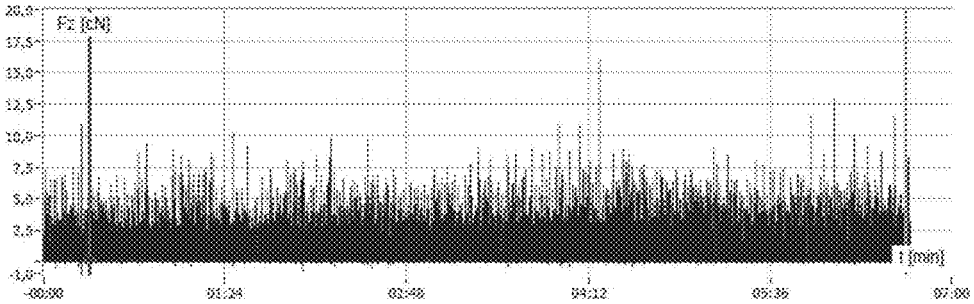
FIG. 3 is a graph showing the unwinding tension versus time for a package of high performance polyethylene (HPPE) yarn wound by closed precision cross winding according to Comparative Example 1 below.

A 110 dtex twisted HPPE or UHMWPE yarn commercially available from DSM Dyneema was wound by open precision cross winding package on a SAHM 260XE. The width of the yarn was ca. 141 μm, the package length 200 mm, the helix angle was kept between 75° to 84°, the δ-value was 2.2 mm, the number of ligatures at the end was 4, and the yarn tension was 80 cN. Unwinding was conducted as described above. Unwinding was conducted as described above. In FIG. 3, the measured unwinding tension is shown. It was observed that even though the unwinding tension is very low most of the time, a number of tension peaks appeared. The peaks mainly appeared to be concentrated around the ends of the package.

Example 2

Figure 4:
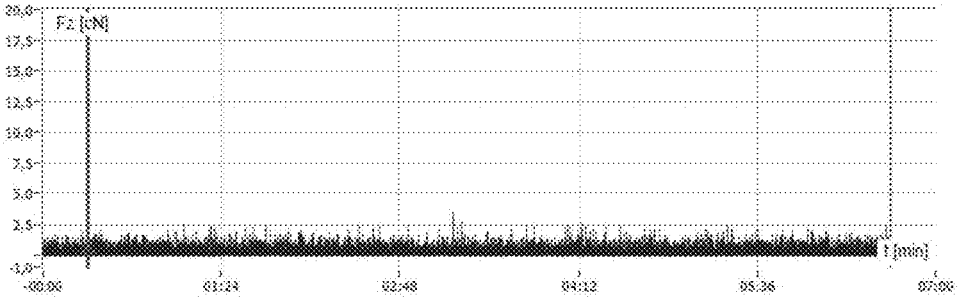
FIG. 4 is a graph showing the unwinding tension for a package of HPPE yarn wound by the open precision cross winding according to Example 2 below of the invention.

A 110dtex twisted HPPE of UHMWPE yarn commercially available from DSM Dyneema was wound by open precision cross winding package according to the invention on a SAHM 260XE. The width of the yarn was ca. 148 μm, the package length 200 mm, the helix angle was kept between 79° to 81°, the δ-value was 1.0 mm, the number of ligatures at the end was 11, and the yarn tension was 80 cN. Unwinding was conducted as described above. In FIG. 4, the measured unwinding tension is shown. It was observed that both the mean tension as well as peak tensions are very low. The (substantially lower) peaks are more in a systematic pattern than in Example 1.

DISCUSSION

In Table 1 the data extracted from the Honigmann HCC-PPT software package is summarized.

| | Comparative Example 1 | Example 2 |
|---|---|---|
| Mean tension [cN] | 0.39 | 0.23 |
| Maximum tension [cN] | 16.08 | 3.51 |
| Minimum tension [cN] | −1.15 | −0.13 |
| Standard deviation [cN] | 0.83 | 0.25 |
| Package Performance Factor (PPF) | 720 | 57.4 |
| Normalized standard deviation [ ] | 2.13 | 1.09 |

As may be observed in Table 1, the package according to the invention (Example 2) clearly outperforms the package of comparative example on all parameters, which also results in an improvement of PPF of more than a factor 12. This is also observed for the normalized standard deviation, where the package according to the invention has a normalized standard deviation of about half of the normalized standard deviation of the package of Comparative Example 1.

An individual feature or combination of features from an embodiment of the invention described herein, as well as obvious variations thereof, are combinable with or exchangeable for features of the other embodiments described herein, unless the person skilled in the art would immediately realize that the resulting embodiment is not physically feasible.

The invention claimed is:

1. A package of a yarn on a bobbin, wherein the yarn is a high performance polyethylene yarn having a linear density of at most 500 dtex, the bobbin is a cylindrical bobbin, the package has two ends and is an open precision cross winding package or a step open precision cross winding package, wherein open refers to adjacent positioned yarns not touching each other over most of the distance between the ends of the package and step refers to a reduction in helix angle during winding so that an outer layer has a lower helix angle that an inner layer, and wherein the normalized standard deviation of the mean unwinding tension measured for 1000 m as Over End Take Off (OETO) with an unwinding speed of 150 m/min is less than 1.5.

2. The package according to claim 1, wherein the OETO normalized standard deviation of the mean unwinding tension is less than 1.25.

3. The package according to claim 1, wherein the OETO normalized standard deviation of the mean unwinding tension is less than 1.1.

4. The package according to claim 1, wherein the package has a number of ligatures at each of the ends of 8 to 25.

5. The package according to claim 4, wherein the number of ligatures at each of the ends is 11 to 19.

6. The package according to claim 4, wherein the helix angle is 75° to 86°.

7. The package according to claim 1, wherein the yarn has a width, $W_{yarn}$ and the package has a δ-value of between 2 $W_{yarn}$ and 100 $W_{yarn}$, wherein the δ-value is the orthogonal distance between the centres of two adjacent positioned yarns.

8. The package according to claim 1, wherein the hardness of the package is 50° Sh to 80° Sh.

9. The package according to claim 1, wherein the difference in hardness of the package 1 cm from the end and the hardness of the package on the middle of the package is less than 10° Sh.

10. The package according to claim 9, wherein the difference in hardness is less than 5° Sh.

11. The package according to claim 1, wherein the yarn has a Young's modulus of at least 50 GPa.

12. The package according to claim 1, wherein the yarn has a Young's modulus of at least 100 GPa.

13. The package according to claim 1, wherein the yarn is a gelspun ultrahigh molecular weight polyethylene (UHMWPE) yarn.

14. The package e according to claim 1, wherein the yarn has a tenacity of at least 13 cN/dtex and less than 75 cN/dtex.

15. The package according to claim 1, wherein the yarn has a width of less than about 0.5 mm.

16. The package according to claim 1, wherein the yarn has a width of less than about 0.1 mm.

17. The package according to claim 1, wherein the yarn has a width of less than about 50 μm.

18. The package according to claim 1, wherein the yarn comprises at least one filament having a width of less than 17 μm.

19. The package according to claim 1, wherein the yarn comprises at least one filament having a width of less than 12 μm.

20. The package according to claim 1, wherein the linear density of the yarn is at most 120 dtex.

21. The package according to claim 1, wherein the linear density of the yarn is at most 45 dtex.

22. The package according to claim 1, wherein at least one of the ends is disturbed by not being substantially orthogonal to the bobbin.

23. The package according to claim 1, wherein at least one of the ends is tapered, zigzagged or randomly distributed in a range.

24. The package according to claim 1, wherein at least one of the ends is tapered outwards.

25. A method of making a yarn construction comprising providing the package according to claim 1, unwinding the yarn from the package, and forming a yarn construction by braiding, knitting, weaving, and/or twisting the yarn unwound from the package.

26. The method according to claim 25, wherein the yarn construction forms at least a part of a medical device.

* * * * *